US008311261B2

(12) United States Patent
Graber

(10) Patent No.: US 8,311,261 B2
(45) Date of Patent: Nov. 13, 2012

(54) ACOUSTIC TRANSDUCER ARRAY

(76) Inventor: Curtis E. Graber, Woodburn, IN (US)

( * ) Notice: Subject to any disclaimer, the term of this patent is extended or adjusted under 35 U.S.C. 154(b) by 671 days.

(21) Appl. No.: 12/583,153

(22) Filed: Aug. 14, 2009

(65) Prior Publication Data

US 2011/0038494 A1 Feb. 17, 2011

(51) Int. Cl.
*H04R 1/02* (2006.01)
*H04R 25/00* (2006.01)

(52) U.S. Cl. ..... 381/386; 381/182

(58) Field of Classification Search ..... 381/182, 381/186, 386, 387; 181/144, 148, 153, 198, 181/199

See application file for complete search history.

(56) References Cited

U.S. PATENT DOCUMENTS 2,831,051 A * 4/1958 Teikowski ..... 381/387
3,100,024 A 8/1963 Leslie
3,842,203 A 10/1974 Weisberg
4,151,437 A 4/1979 Tocquet
4,380,808 A 4/1983 Hill et al.
4,503,930 A 3/1985 McDowell
4,604,542 A 8/1986 Thompson
4,633,229 A 12/1986 Iacono
4,805,730 A * 2/1989 O'Neill et al. ..... 181/148
4,862,508 A 8/1989 Lemon
4,916,675 A 4/1990 Hoering
5,146,508 A 9/1992 Bader
5,687,667 A 11/1997 Barron
6,016,353 A 1/2000 Gunnuss

* cited by examiner

*Primary Examiner* — Brian Ensey
(74) *Attorney, Agent, or Firm* — Paul W. O'Malley; Susan L. Firestone

(57) ABSTRACT

A loudspeaker system comprises a plurality of speaker transducer units divided among and arrayed in at least three linear arrays. The linear arrays are disposed in a like plurality of elongated rectangular baffles. The elongated rectangular baffles are disposed in side by side relationship along the respective elongated sides of the baffles in the form of a tube. The speaker transducer units are aligned in a plurality of ranks. The ends of the tube are closed with the result that one side of speaker transducers radiates into the interior of the enclosure and the other side radiates into the environment. The speaker transducers of each rank are spaced no further from one another than one quarter wavelength at a selected frequency.

11 Claims, 14 Drawing Sheets

ACOUSTIC TRANSDUCER ARRAY

BACKGROUND

1. Technical Field

The technical field relates generally to loudspeaker arrays and array support arrangements, particularly loudspeaker arrays for an omni-directional public address and warning system.

2. Description of the Art

The art has long recognized the difficulty in obtaining substantially uniform sound propagation from an electronic warning system in all directions in a plane. Warning systems have commonly been based on multi-speaker systems utilizing rectangular speakers arranged in a circumferentially spaced relationship in a common horizontal plane. Iacono et al., in U.S. Pat. No. 4,633,229, attributed the problem on uneven distribution of sound from such a system to interference between adjacent speakers resulting in cancellation effects in certain directions. Iacono proposed a system in which adjacent loudspeakers were driven at different frequencies. While such a system should be effective in eliminating cancellation it is less useful where the intent is to broadcast intelligible speech since, among other things, there would be a change in the pitch depending on the direction from the array. The consequences for music would be stronger given there would be fewer dead moments to resynchronize signals between speakers to correct for cumulative loss of synchronization stemming the frequency differences. The directivity characteristics of sound fields for a loudspeaker system over a broad range of operating frequencies have consequences for audience coverage while retaining intelligibility for public address and other applications.

SUMMARY

A loudspeaker system comprises a plurality of speaker transducer units divided among and arrayed in at least three linear arrays. In one embodiment the linear arrays are disposed in a like plurality of elongated rectangular baffles. The elongated rectangular baffles are disposed in side by side relationship along the respective elongated sides of the baffles to form a multi-sided tube. The speaker transducer units are aligned in a plurality of ranks. The ends of the tube are closed with the result that one side of speaker transducers radiates into the interior of the enclosure and the other side radiates into the environment. The speaker transducers of each rank are spaced no further from one another than one quarter wavelength of a selected minimum frequency.

DETAILED DESCRIPTION

Figure 1:
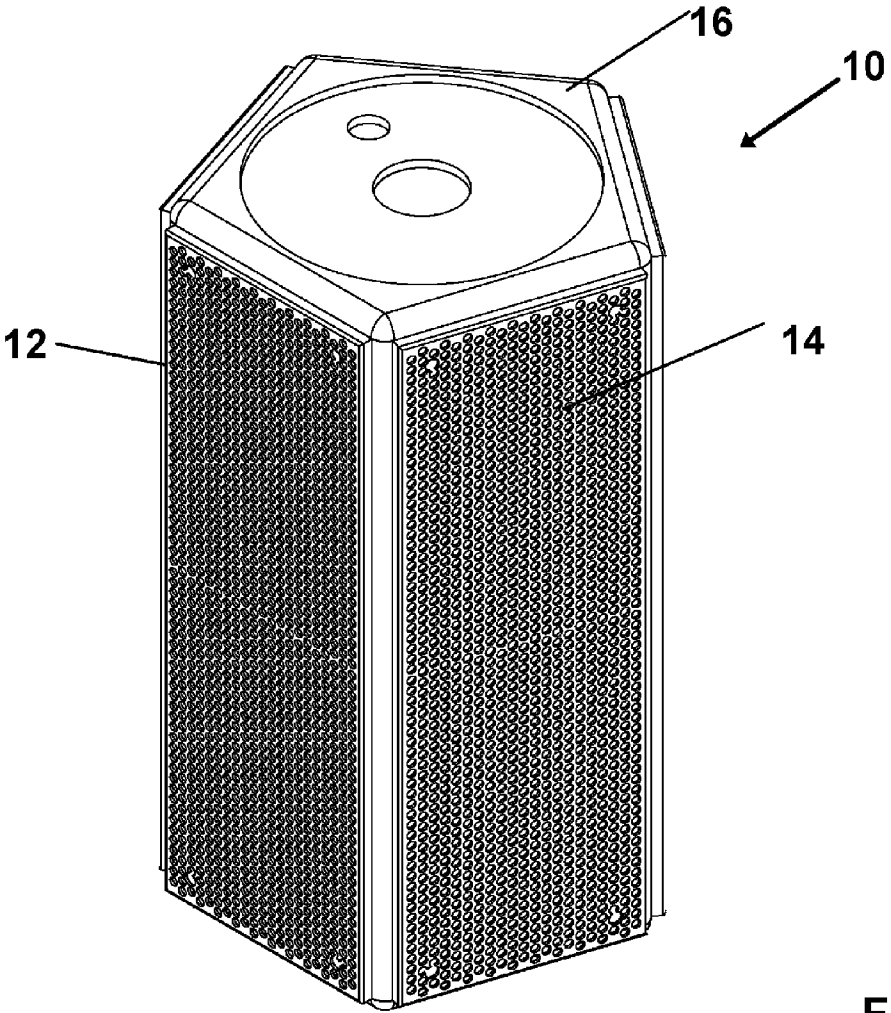
FIG. 1 is a perspective view of an enclosure for supporting the loudspeaker array.
Figure 2:
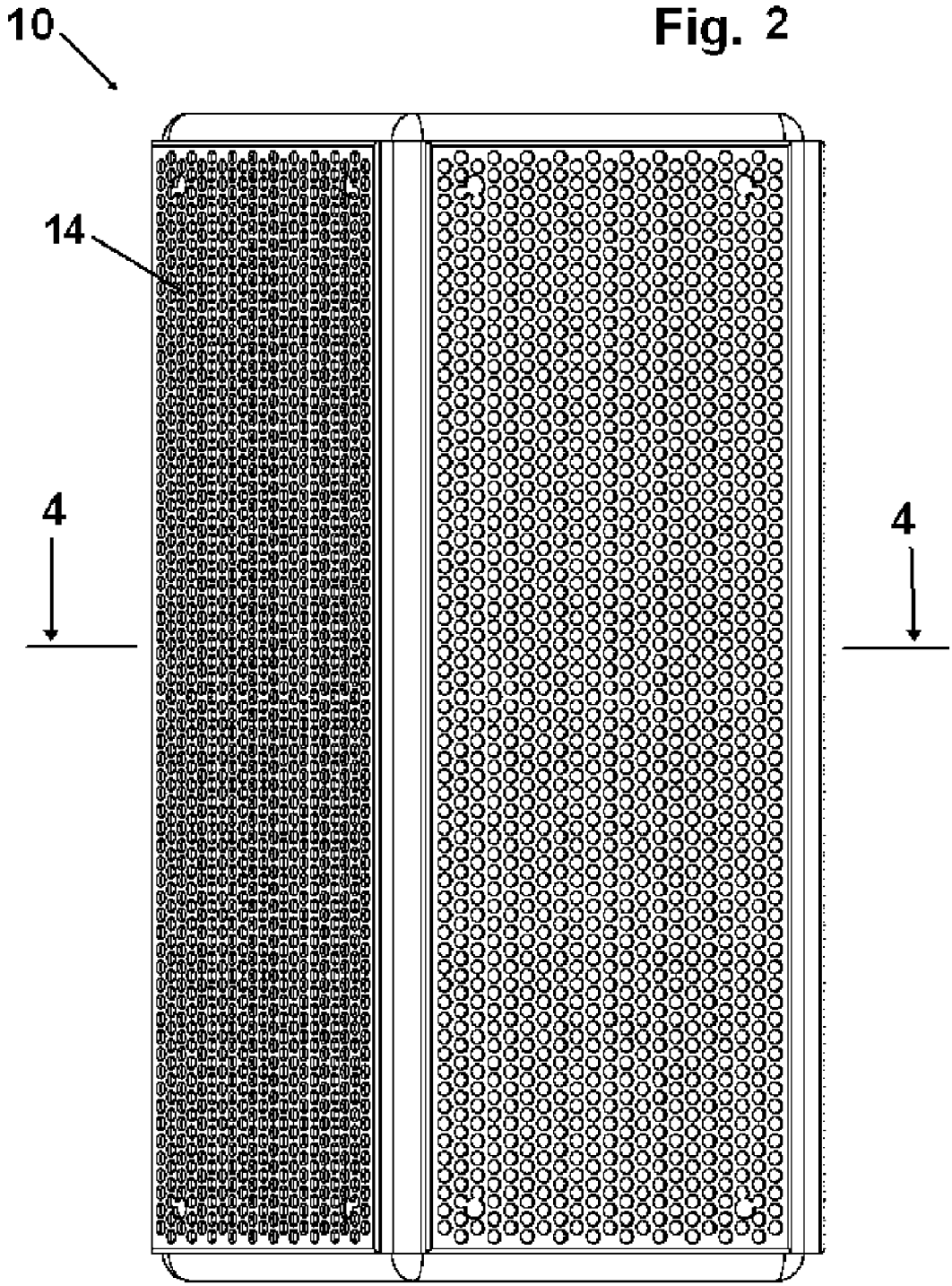
FIG. 2 is a side elevation of the enclosure of FIG. 1.
Figure 3:
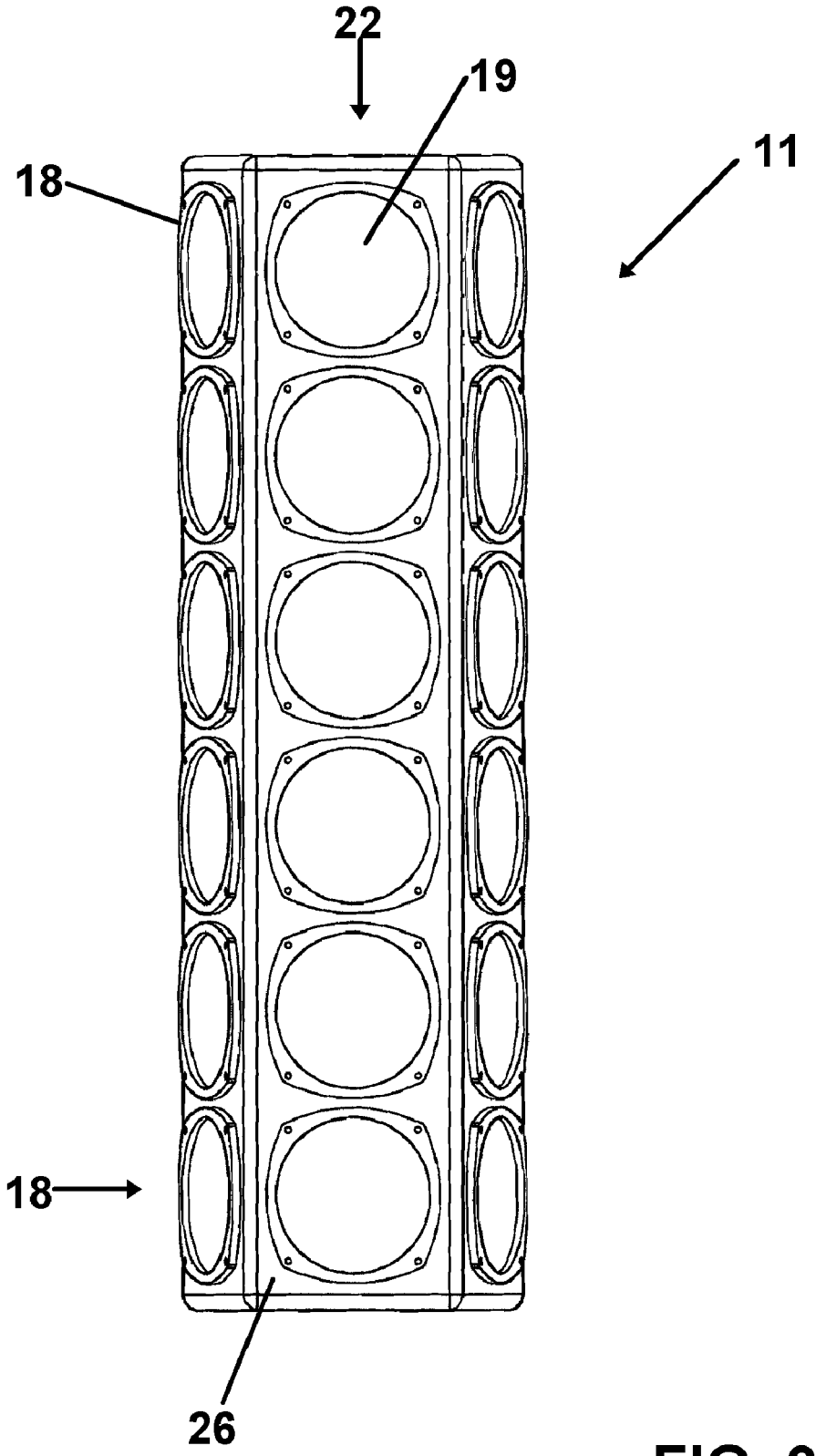
FIG. 3 is an elevation view of a portion of the loud speaker array.
Figure 4:
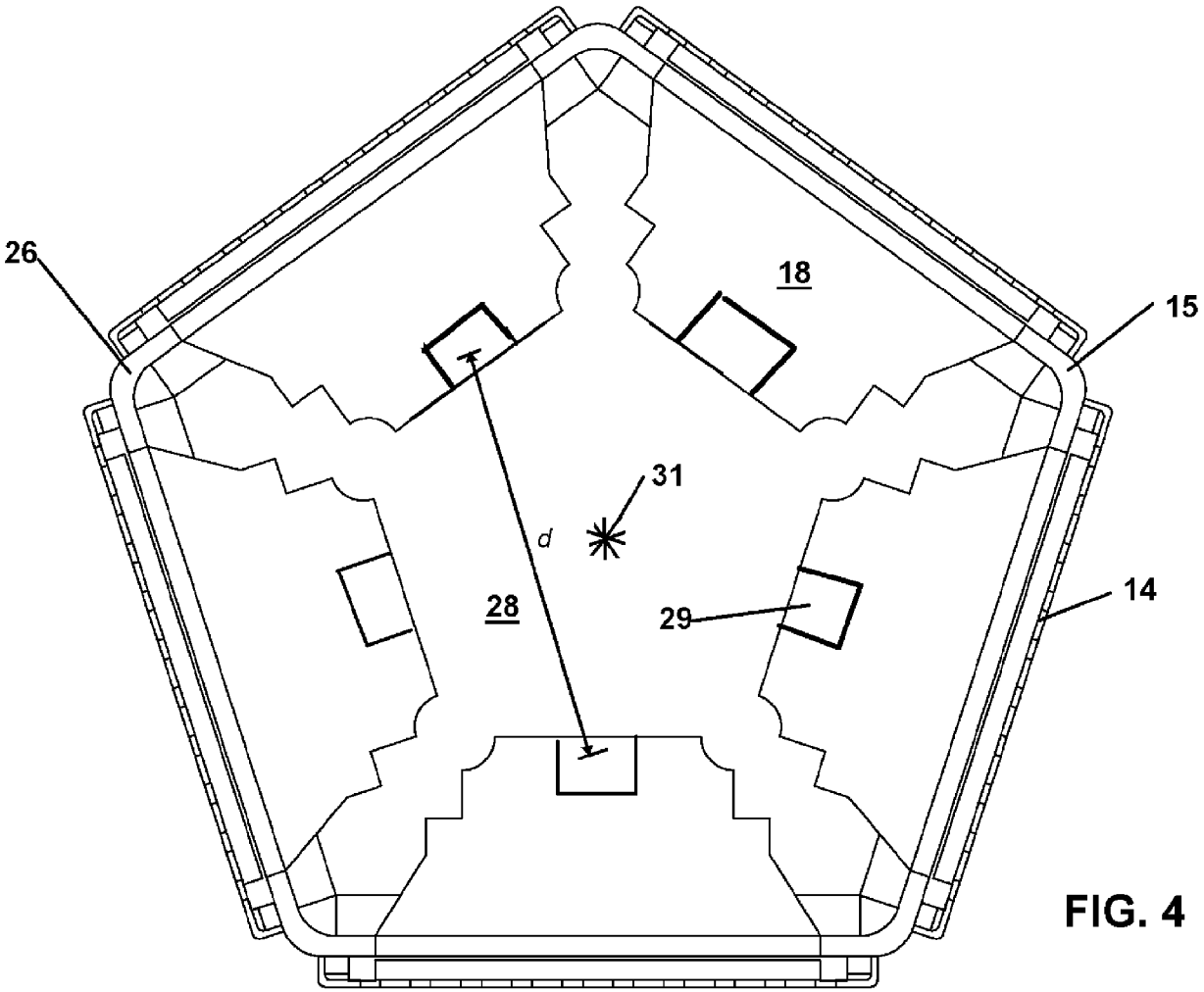
FIG. 4 is a cross sectional view of the enclosure of FIGS. 1 and 2 taken along section lines 4-4 of FIG. 2.

In the following detailed description, like reference numerals and characters may be used to designate identical, corresponding, or similar components in differing drawing figures. Furthermore, example sizes/models/values/ranges may be given with respect to specific embodiments but are not to be considered generally limiting. In circuit diagrams well-known power and ground connections, and similar well-known elements, may be omitted for the sake of simplicity of illustration.

An acoustic linear array may be modeled using "simple" sound sources evenly spaced along an axis and in line with one another. A "simple" sound source is more an intellectual conception than practical technology and in practice linear arrays are constructed from a plurality of cone type loudspeakers directed to radiate in the same direction. The array of loudspeakers is set in a plane baffle. The baffle may be, and often is, positioned over an enclosure so that the combination of a baffle and enclosure emulates an "infinite" baffle. Practical linear arrays have been less than fully the three-dimensional arrays of a plurality of ideal point sources.

A linear array can be used to shape the cumulative sound field produced by its constituent loudspeakers. The acoustic outputs of the loudspeaker produce patterns of constructive and destructive interference when the frequencies' spectrums are closely matched and the phase nearly synchronized. The operational frequency range of the device depends upon the spacing of adjacent loudspeakers compared to the wavelengths of the output sound field. The resulting compound sound field may be compressed onto a plane which is perpendicular to the orientation of the axis of alignment of the speakers. The greater the number of loudspeakers in the array the greater the degree of compression, both vertically. In addition, the polar directivity pattern of the output/sound field in the plane of compression assumes lobes in which the sound field is more intense. It is not necessary that the reproduced sound from each loudspeaker be perfectly in-phase. Dynamic relative phase adjustment of the drive signal to each speaker allows the sound field to be steered parallel to the axis of alignment of the loudspeakers in the array. The array may be oriented in any direction, though typically the enclosure is oriented so that the loudspeakers are stacked vertically with reference to the ground. In this case the resulting sound field is onto the plane most closely corresponding to the ground and the field can be steered up and down.

The sound field of such stacked or linear arrays is not omni or non-directional on the plane of compression at its effective frequencies. The sound field exhibits a directivity pattern which is lobed, that is, the intensity of the sound field varies around the array with the highest intensity (the principal lobe) occurring directly in front of the loudspeakers. In a classic model of perfect point sources not set in a baffle there is no lobe effect in the directivity pattern.

Referring to the figures, particularly FIGS. 1-4, an enclosure 10 supporting a loudspeaker array 11 is shown. Loudspeaker array 11 can function as an array of arrays, or, put another way, as a three-dimensional array of acoustic transducers. Array 11 has a plurality of columns/linear arrays 22 and a plurality of rows or ranks 24 of acoustic transducers which lie perpendicular to the axes of the columns. The acoustic transducers may be cone type loudspeakers 18 and are typically sized for operation over a frequency range between about 150 Hz. and 3 KHz. for use in public address applications. Other applications may involve different operational ranges.

In one embodiment an enclosure 10 is based on an elongated tube 15 which is closed at each end by end closure plates 16. Sides for enclosure 10 are provided by planar, rectangular sides 12 corresponding in number to the number of columns of acoustic transducers in the array 11 with each rectangular side supporting one column of speakers 18 disposed along the long axis of the rectangle. Sides 12 comprise baffles 26 through which the cone type loudspeakers 18 may be mounted with the front radiating surfaces 19 of loudspeakers 18 facing outwardly. Baffles 26 and radiating surfaces 19 may be covered by perforated coverings 14 to protect cone type loudspeakers 18 from physical damage. In one embodiment a tube 15 has five sides 12 and is given a cross-sectional shape in the form of a regular pentagon. The number of sides 12 which may be used may vary from as few as three to as many as can be fit together, with a consequential increase in complexity of the control arrangements. Typically only one column of loudspeakers 18 is provided for each rectangular side, however, it is conceivable that more than one column could be used making each rectangular side into a sort of flat panel array.

The rearward surfaces 21 of loudspeakers 18 face inwardly on an interior chamber 28 defined by the enclosure 10. Interior chamber 28 is illustrated as common to the entire array 11, however divided chambers could be used for individual loudspeakers 18 or for a given rank or row 24. The piston 29 for a cone type loudspeaker 18 of a given rank or row 24 is spaced by a distance d no more than one quarter wavelength of the highest selected effective operating frequency of the array 11 from the piston 29 for the most distant of any of the remaining four loudspeakers 18 of the same row. This is not to say that the system has no effect above the highest intended operating frequency, just that the directivity pattern of the lobes becomes highly variable with further increases in frequency. The loudspeakers 18 for a given rank or row 24 are located in a plane perpendicular to a hypothetical central axis 31 for the array 11 running through the middle of the interior chamber 28.

Figure 5:
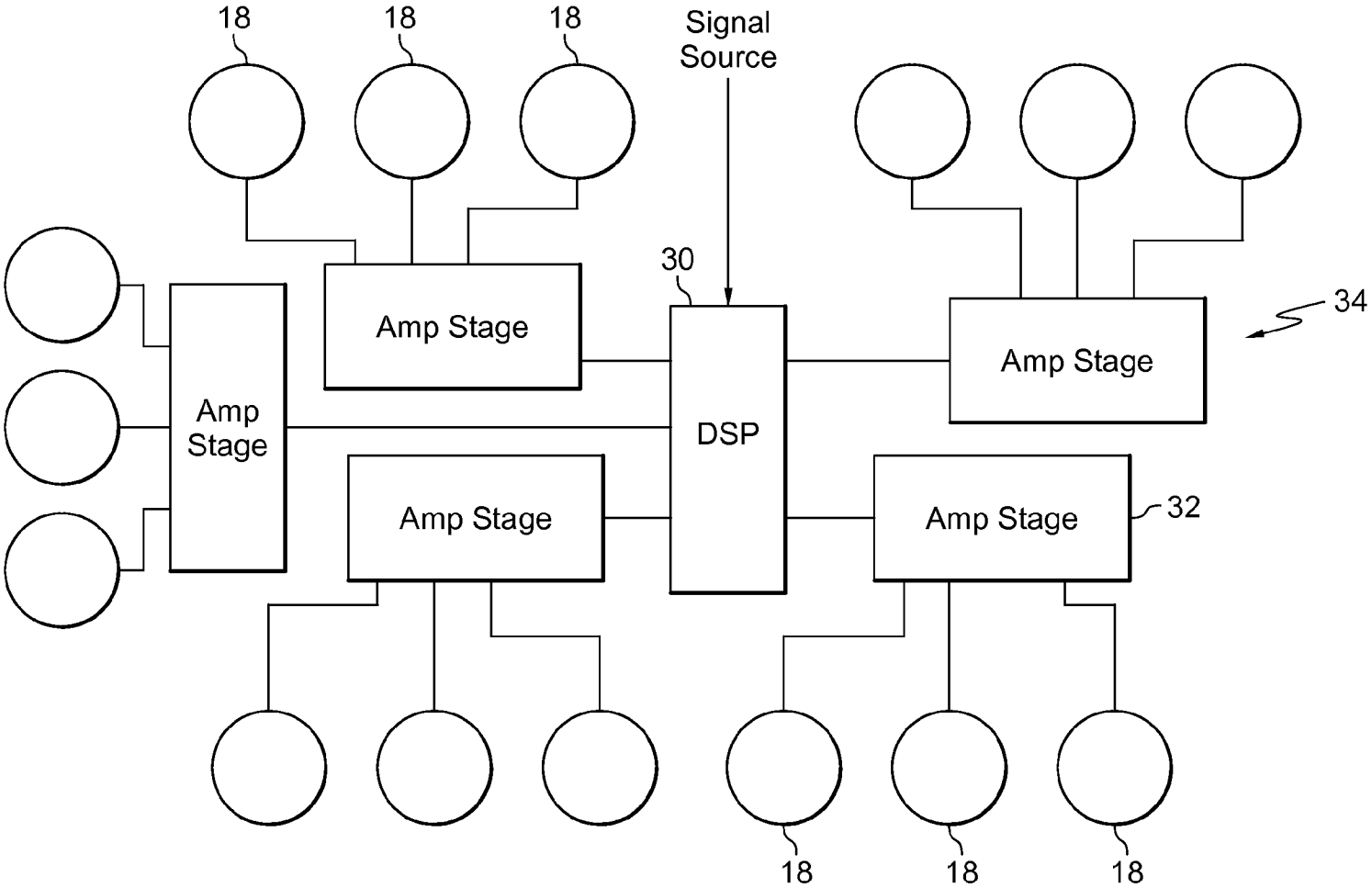
FIG. 5 is a block diagram of a signal source for the loud speaker array of FIG. 3.

FIG. 5 illustrates possible drive circuitry 34 for array 11. Drive circuitry 34 includes amplifier stages 32 for each of five groups of loudspeakers 18 associated by connection to a particular amplifier stage 32. A digital signal processor 30 is interposed between a signal source and the amplifier stages 32 and may be used to control the phase relationship between the signals supplied the groups of transducers or among individual transducers. Where the groups correspond to rows or ranks 24 of loudspeakers 18 the phase relationship of the signals supplied to the amplifier stages may be controlled to steer the angle of the plane of the projected sound field upwardly or downwardly. Where the groups of loudspeakers 18 correspond, columns or linear arrays 22 the phase relationship may be varied between columns. Logically the control may be carried down to the individual transducer level with each transducer being provided with a digital signal processor and amplifier to allow dynamic phase shifting and amplitude control at the discrete transducer level and provide complex shaping of the resulting sound field. Central control of the DSP units and amplifiers would allow the ad hoc association of transducers from different rows and columns into "groups" for purposes of steering the sound field vertically and controlling or rotating the directivity pattern in the plane of compression and for controlling the tilt of the field with respect to the central axis of the array 11.

Figure 6:
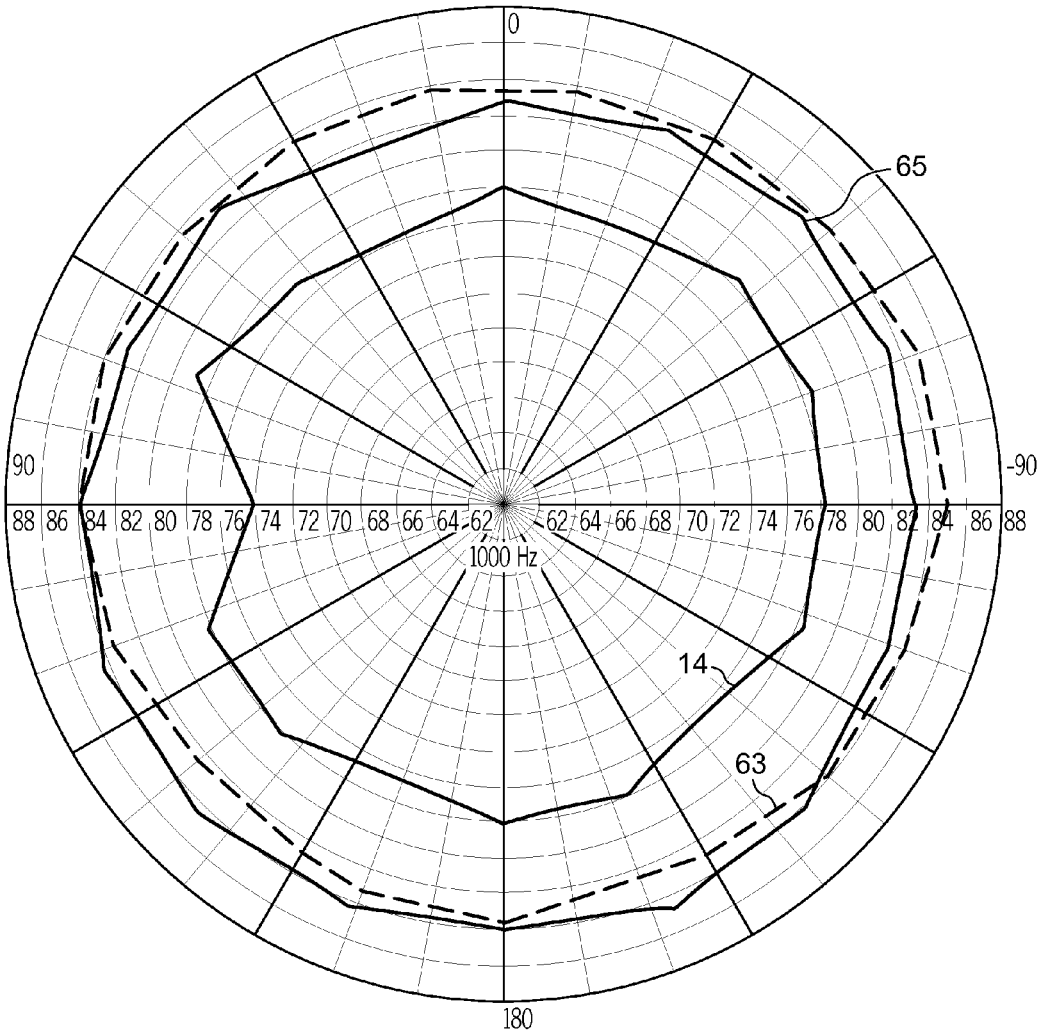
FIG. 6 is a polar diagram of a directivity pattern for the loud speaker array of FIG. 3 in a frequency range for a normal range of human voice.
Figure 7:
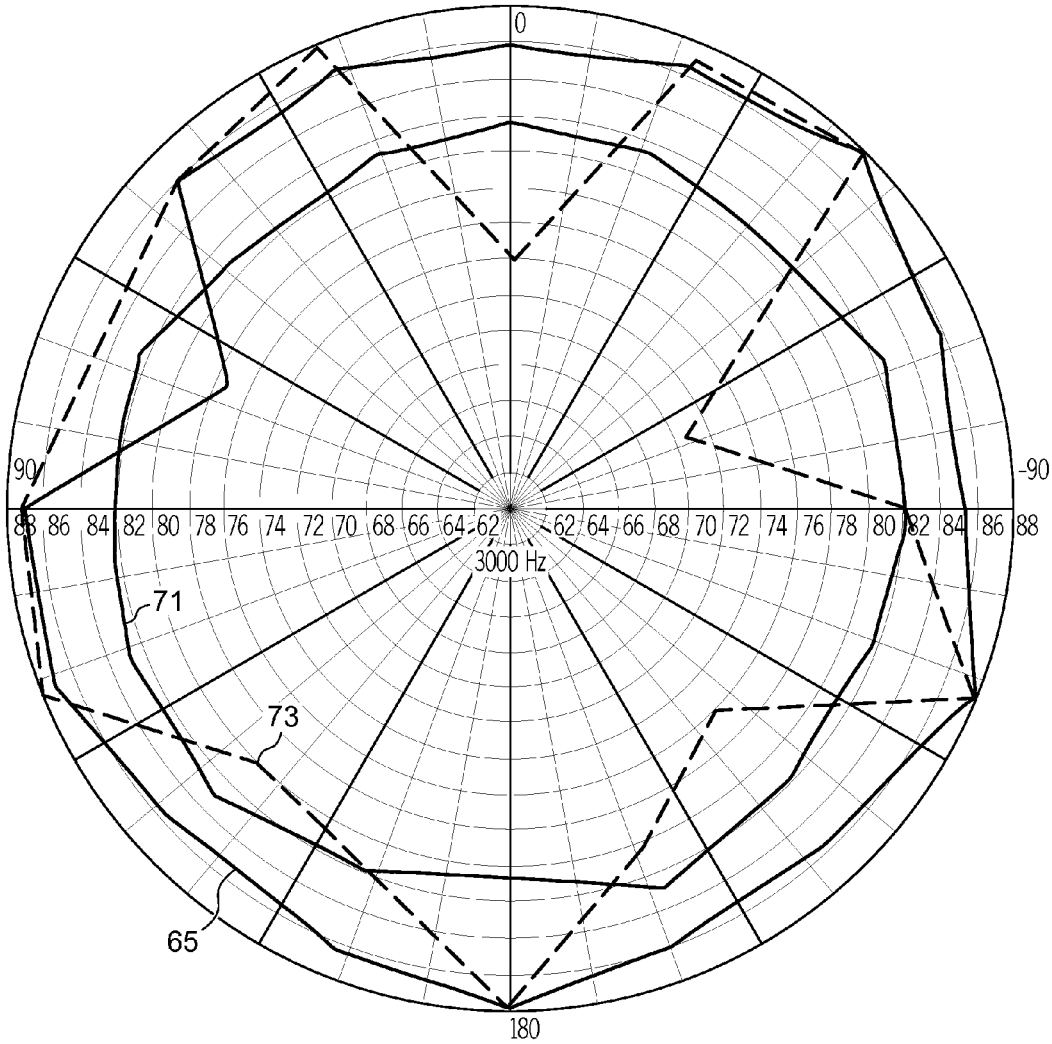
FIG. 7 is a polar diagram of a directivity pattern for the loud speaker array of FIG. 3 over frequencies above the normal range of the human voice.

FIGS. 6 and 7 illustrate field tests of systems built in accordance with the teachings herein conducted over a 25 acre near free field environment. FIG. 6 illustrates the directivity pattern/polar far field response over a vocal frequency range of 250 to 1000 Hz. The three frequencies checked corresponding to the low, middle and high end of the range (plots 65, 63 and 61 of the graph) illustrate nearly even signal intensity around a five sided array. FIG. 7 represents analysis of an alarm operational range from 800 to 3000 Hz. At the low and middle frequency values for this range (plots 71 and 75) the intensity was nearly even at all angles. At the highest frequency checked (3000 Hz.) the plot 73 begins to show distinct lobes corresponding to the five sides of the array tested.

Figure 8:
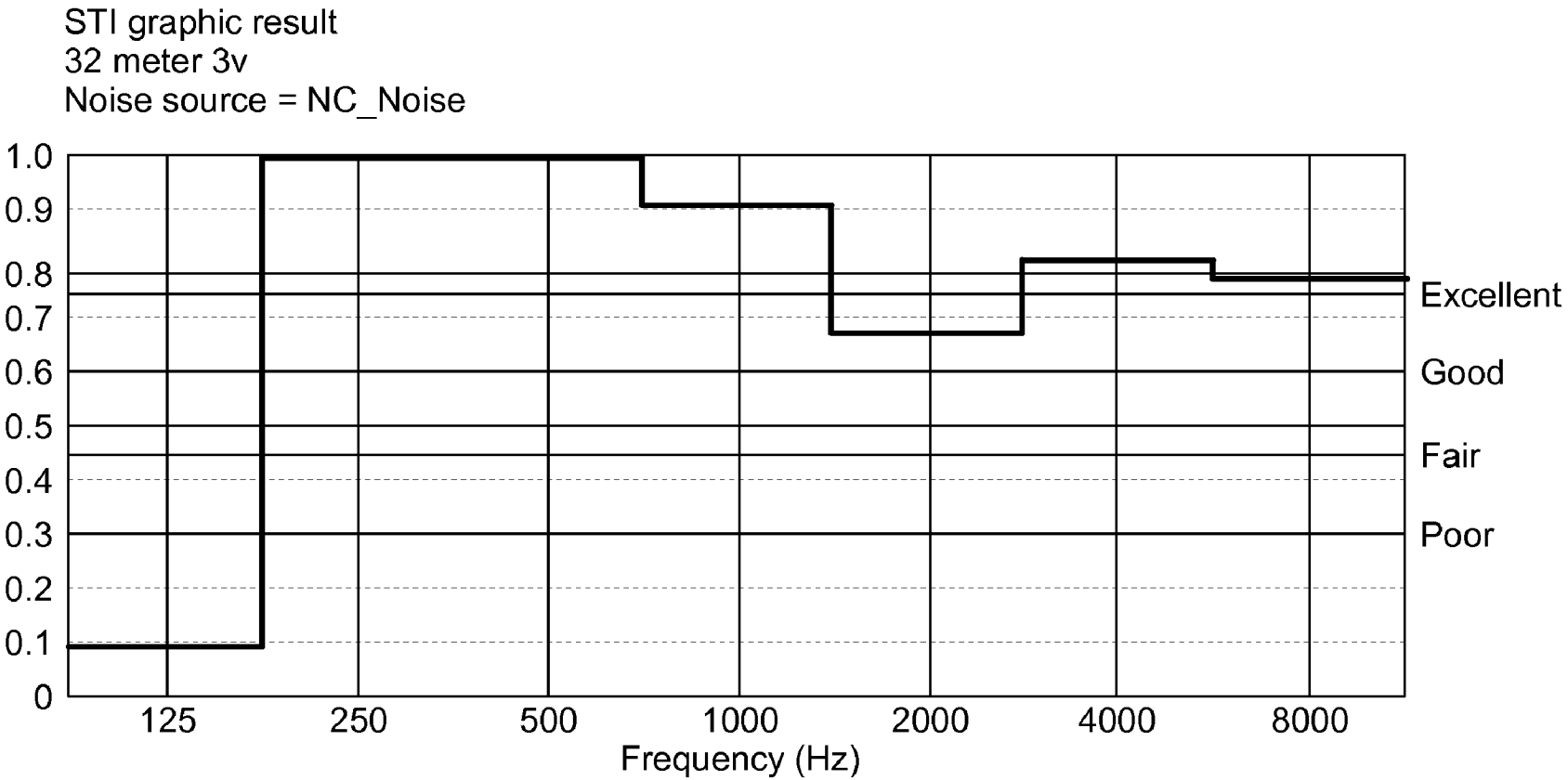
FIG. 8 is a polar diagram of a directivity pattern for the loud speaker array of FIG. 3 over frequencies above the normal range of the human voice.

For the frequency response over the lower human voice range, FIG. 8 illustrates high levels of speech intelligibility over the array's operating range.

Figure 9:
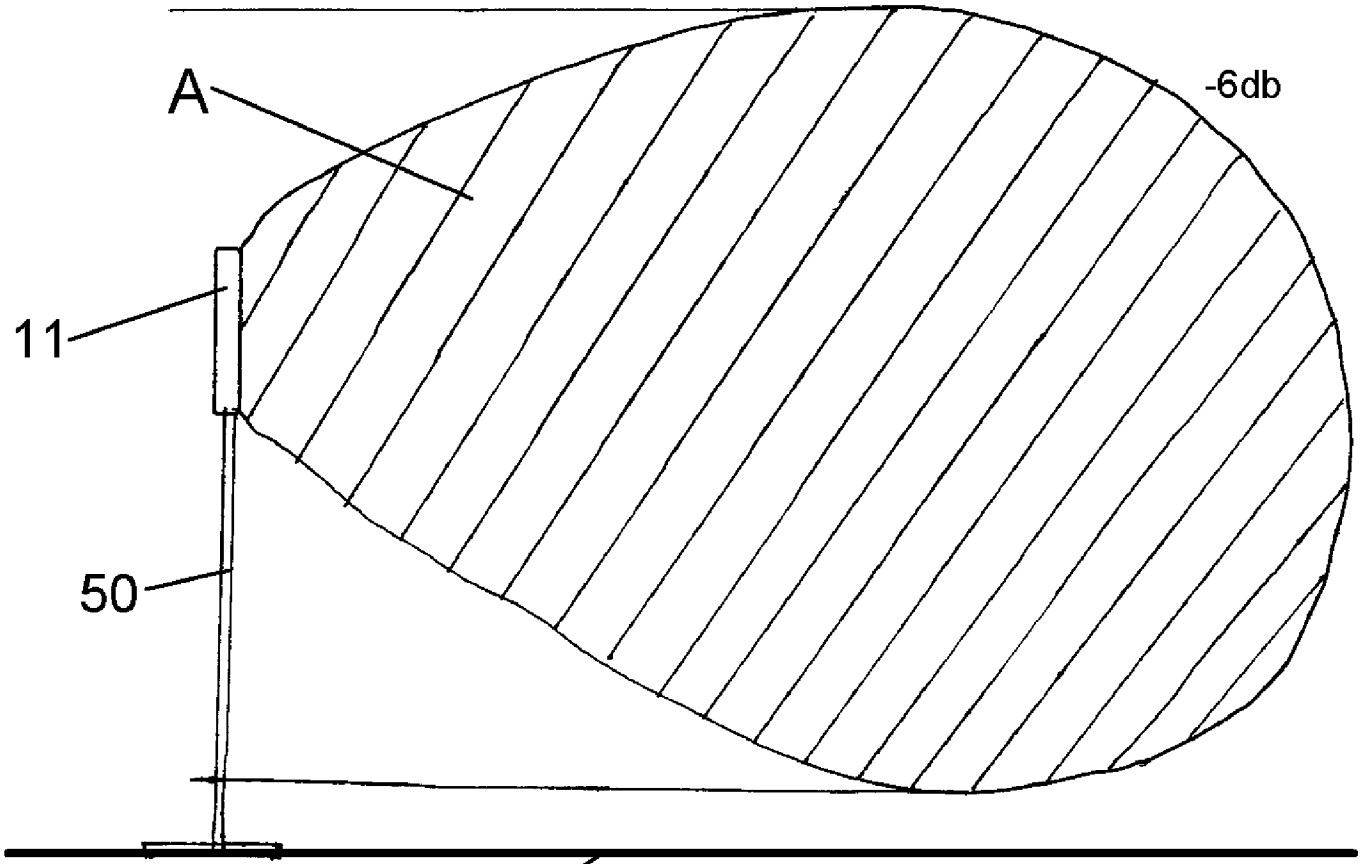
FIG. 9 is a vertical cross section of a sound field.
Figure 10:
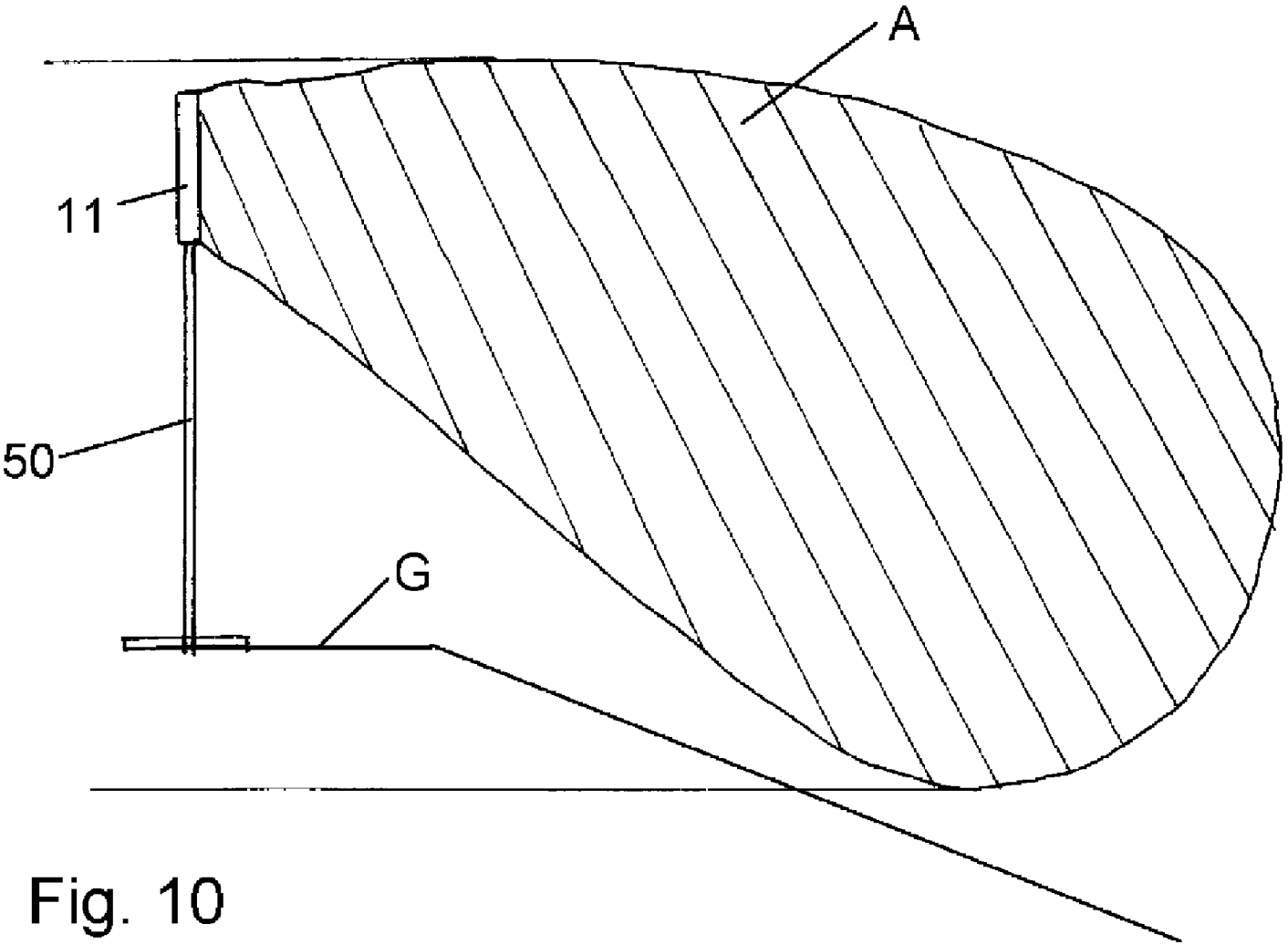
FIG. 10 is a vertical cross section of a sound field shaped by relative phase adjustment of a loudspeakers in an array.
Figure 11:
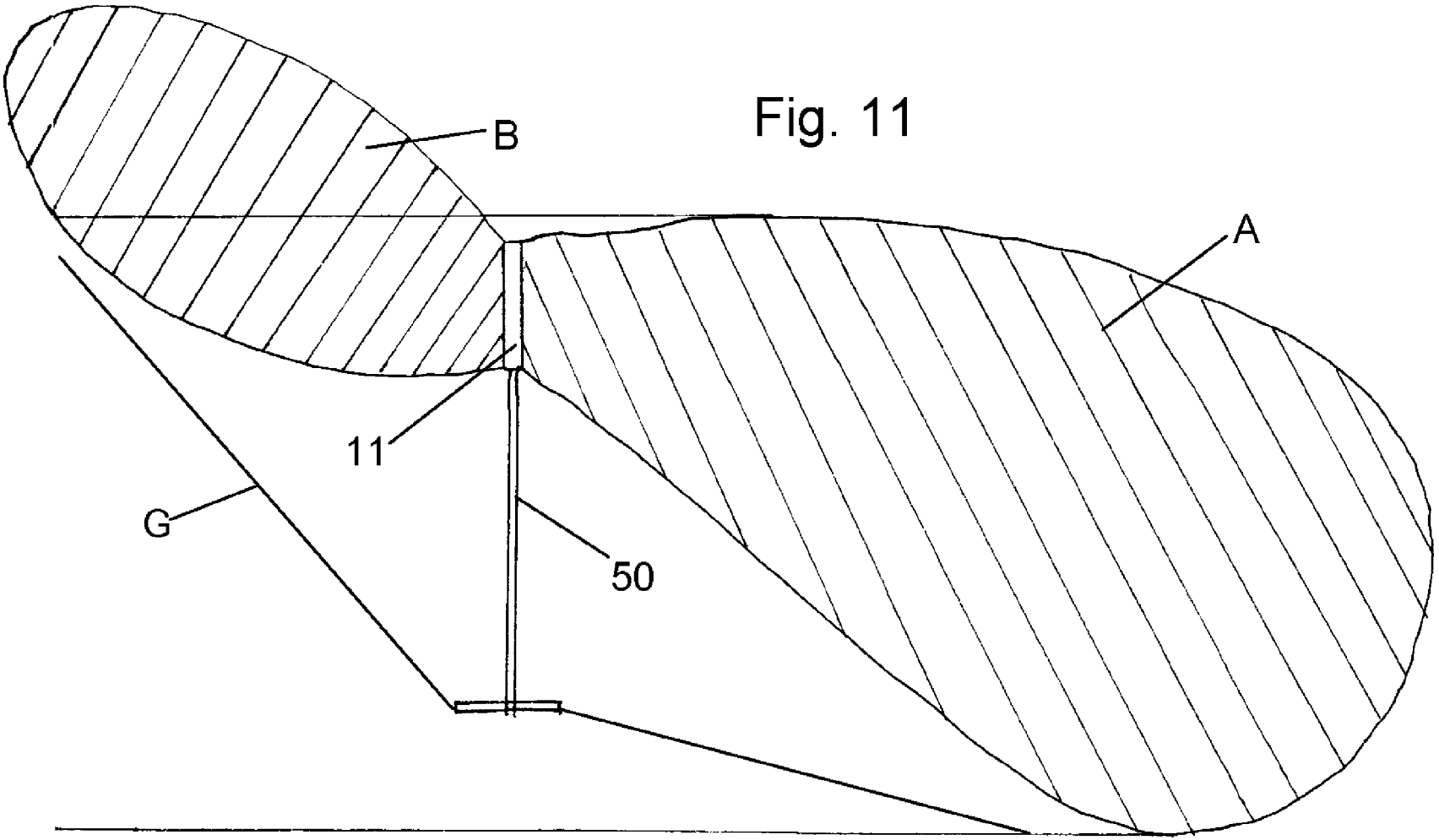
FIG. 11 is a vertical cross section of a sound field having at least two oppositely directed lobes.

FIGS. 9-11 illustrate control of tilting of lobes A and B (the borders of which correspond to a −6 db sound field intensity drop of) of a sound field produced by an array 11 set on a pole 50 which positions the array 11 at some height above the ground level G. Ground level G may correspond to the floor of an arena. The primary lobe A may be tilted up or down and the degree of the lobe compression in the vertical axis adjusted. A secondary lobe B may be directed upwardly or downwardly either to intercept the ground level G or render the presence of the secondary lobe B insignificant.

Figure 12:
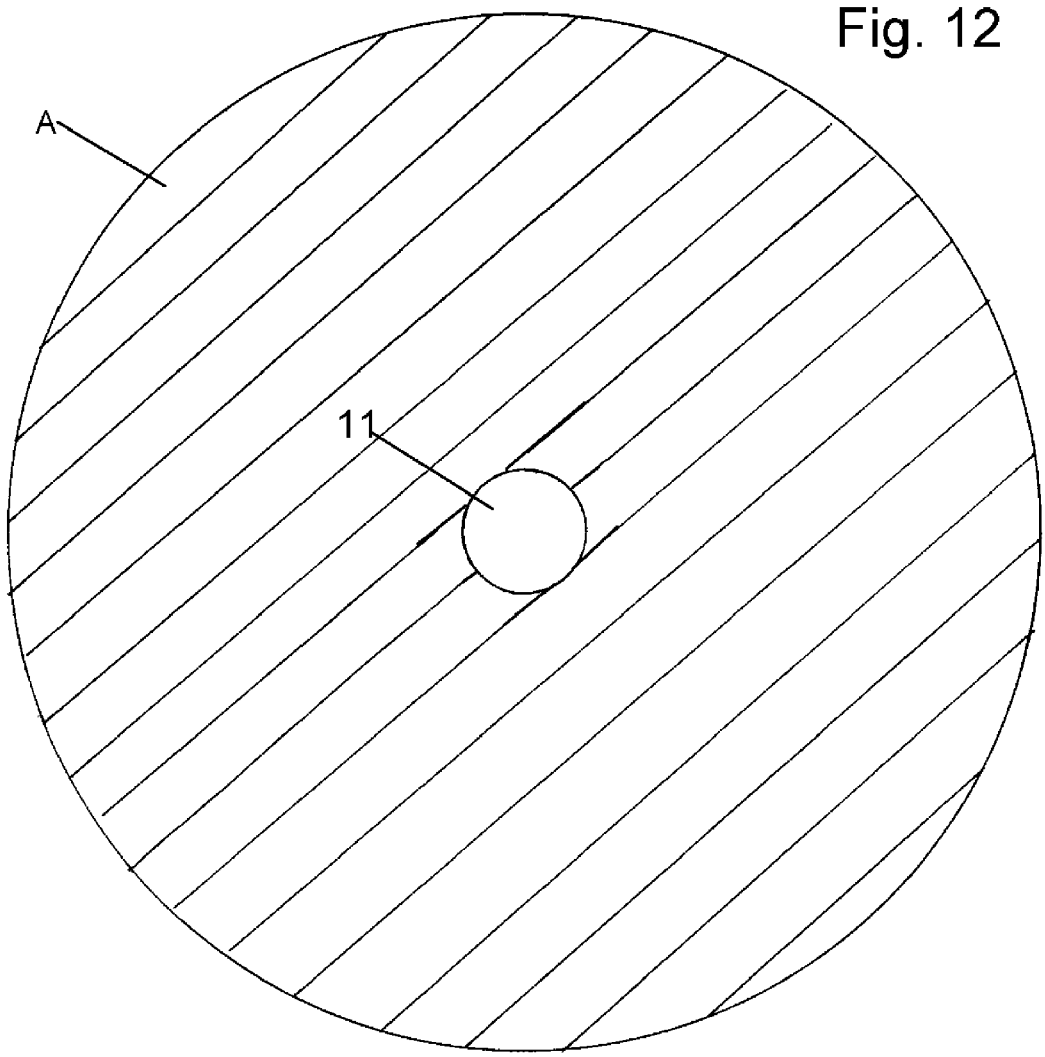
FIG. 12 is a polar diagram of a directivity pattern for the loud speaker array.
Figure 13:
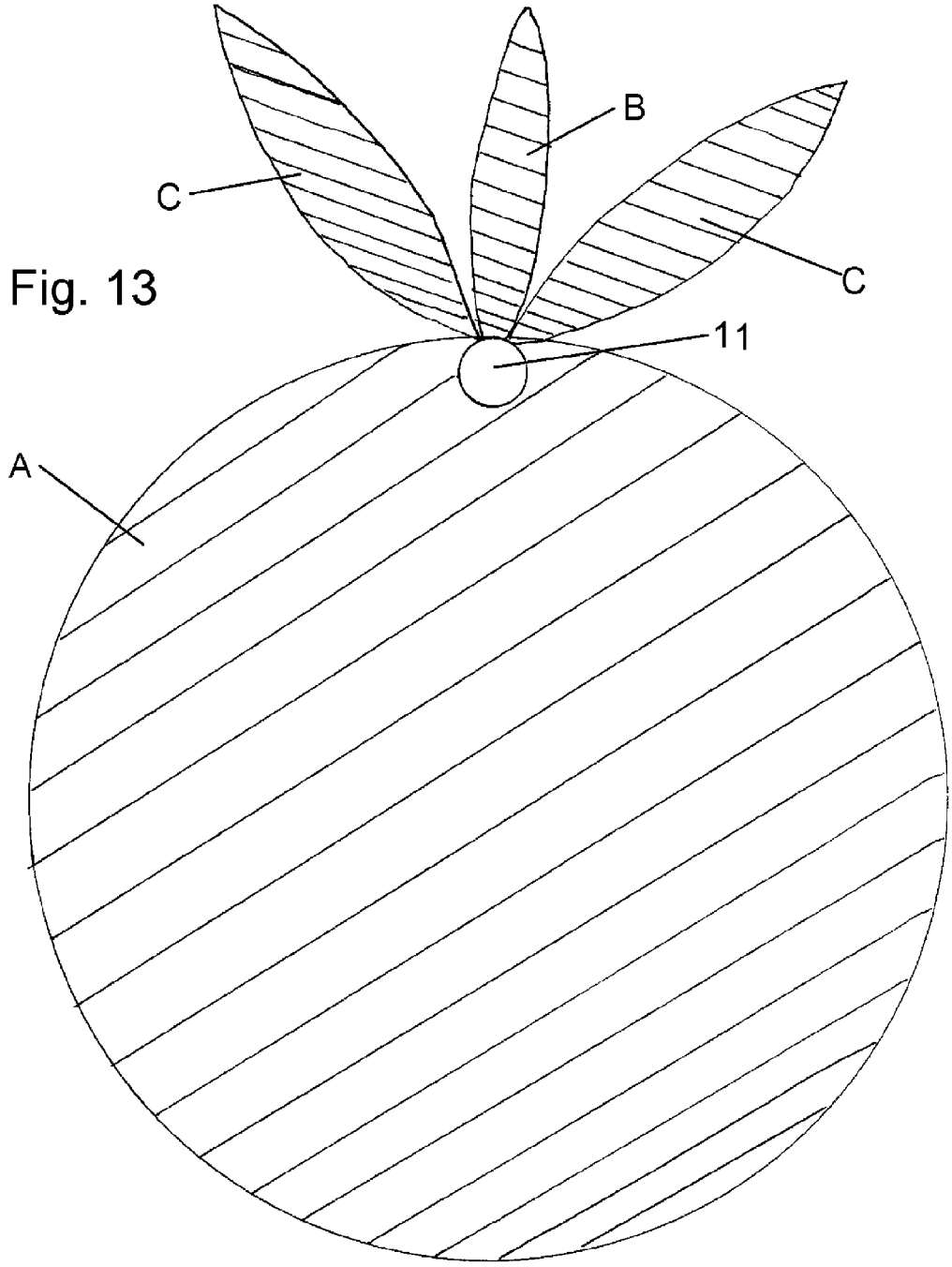
FIG. 13 is a polar diagram of a directivity pattern for the loud speaker array.
Figure 14:
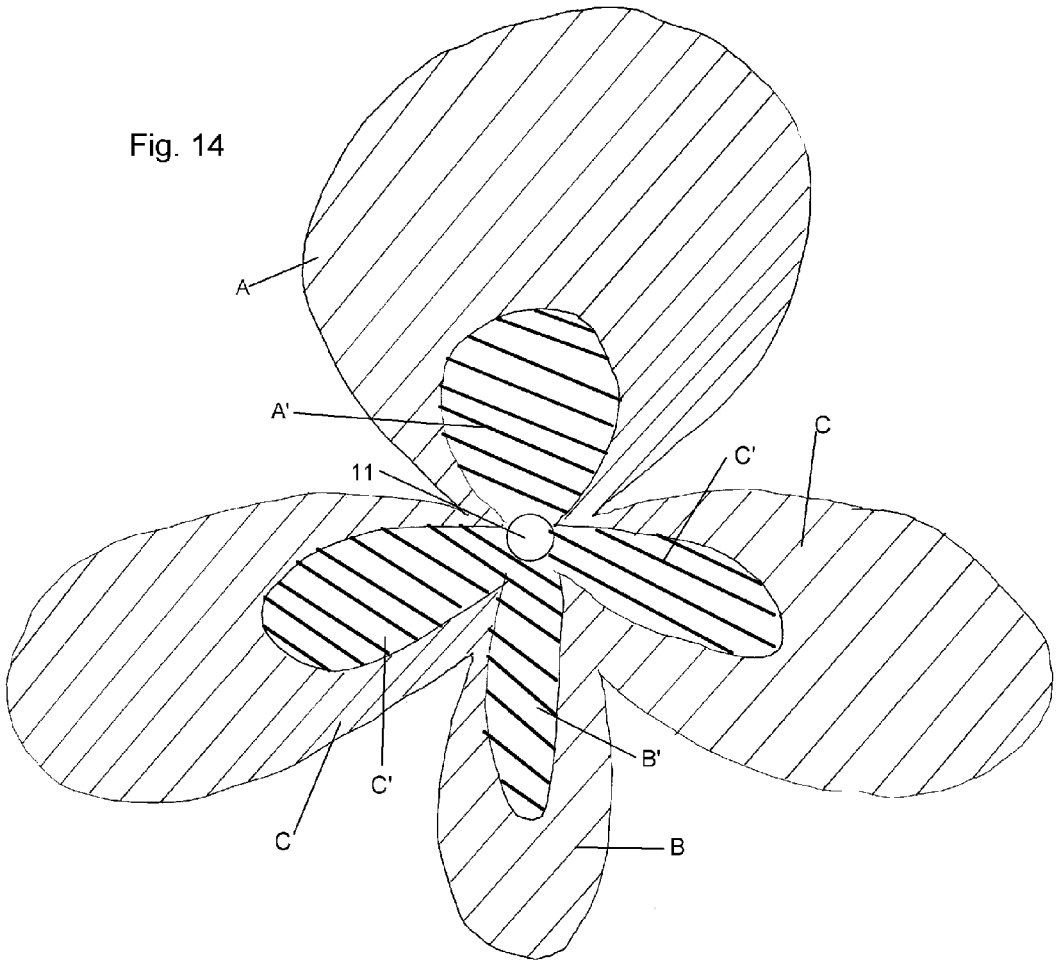
FIG. 14 is a polar diagram of a directivity pattern for the loud speaker array.

FIGS. 12-14 illustrate possible directivity patterns produced by array 11. These include an apparent single lobe A as shown in FIG. 12 where the primary lobes from a plurality of columns blend into a sound field with a seemingly constant directivity pattern. FIGS. 13 and 14 illustrate directivity patterns including lobes A, B and C where A is the primary lobe. FIG. 14 further illustrates lobes in the −3 db and −6 db ranges.

What is claimed is:

1. A loudspeaker system, comprising:

a plurality of speaker transducer units each having a primary and a secondary radiating surface, the speaker transducer units being divided among and arrayed in a plurality of exclusive linear arrays of at least three in number;

a plurality of elongated rectangular baffles with one elongated rectangular baffle being provided for each exclusive linear array;

the plurality of linear arrays being disposed in the plurality of elongated rectangular baffles;

the plurality of elongated rectangular baffles being disposed in side by side relationship along respective elongated sides in a closed circuit with one speaker transducer unit of each baffle being aligned with a speaker transducer unit from each of the remaining baffles in a plurality of ranks;

end pieces set at each end of a resulting structure to form an enclosure for the plurality of speaker transducers;

the primary radiating surface of each speaker transducer unit being oriented outwardly from the enclosure; and the speaker transducers of each rank being no further spaced from one another than one quarter wavelength of a selected frequency.

2. The loudspeaker system of claim 1, further comprising:

the enclosure having five sides parallel to a central axis, the five sides providing baffles for mounting one linear array of speaker transducers.

3. The loudspeaker system of claim 2, further comprising:

electrical drive circuitry for driving selected elements of the array to project a sound field onto a plane through an angle up to 360 degrees.

4. A loudspeaker system, comprising:

a straight tube;

an array of speaker transducers mounted in rows and columns on the tube with a plurality of speaker transducers in each of the rows extending circumferentially around the straight tube and with a plurality of speaker transducers in each of the columns extending along the straight tube with the spacing between adjacent speaker transducers in each colum being less than one quarter wavelength of a lower wavelength limit; and the diameter of the tube being set so that a maximum spacing between any pair of speaker transducers in a row being less than one quarter wavelength of a lower wavelength limit.

5. The loudspeaker system of claim 4, further comprising:

the straight tube having five sides arranged in a right pentagon, the five sides providing baffles for mounting one column each of speaker transducers.

6. The loudspeaker system of claim 5, further comprising:

electrical drive circuitry for driving selected elements of the array to project a sound field onto a plane through an angle up to 360 degrees, the sound field being characterized by less than a maximum drop off in sound intensity from the loudspeaker system.

7. The loudspeaker system of claim 5, further comprising:

the baffles abutting one another along sides; and the straight tube being closed at opposite ends at locations spaced along the central axis to form an enclosure.

8. A loudspeaker system, comprising:

a plurality of linear arrays of speaker transducers positioned parallel with respect to each other and to a central axis, the linear arrays being arranged in columns with the columns collectively being radially disposed around the central axis and oriented outwardly from the central axis; and a maximum spacing between any pair of columns in a plane perpendicular to the central axis less than one quarter wavelength of a lower wavelength limit.

9. A loudspeaker system as set forth in claim 8, further comprising:

the linear arrays having radiating surfaces which are rotated relative to one another to cover an angle of 360 degrees around the central axis.

10. The loudspeaker system of claim 9, further comprising:

five linear arrays.

11. The loudspeaker system of claim 9, further comprising:

electrical drive circuitry for driving selected elements of the array to project a sound field onto a plane through an angle up to 360 degrees.

* * * * *